US005740512A

United States Patent [19]

Hayashi et al.

[11] Patent Number: 5,740,512

[45] Date of Patent: Apr. 14, 1998

[54] IMAGE FORMATION SYSTEM WITH SWELL CORRECTION

[75] Inventors: Yukio Hayashi; Norio Hokari; Shuji Iseki; Junichirou Sameshima; Mikio Kobayashi; Ryoichi Tsuruoka, all of Ebina, Japan

[73] Assignee: Fuji Xerox Co., Ltd., Tokyo, Japan

[21] Appl. No.: 734,545

[22] Filed: Oct. 21, 1996

[30] Foreign Application Priority Data

Oct. 27, 1995 [JP] Japan ..... 7-280384

[51] Int. Cl.[6] ..... G03G 15/16

[52] U.S. Cl. ..... 399/316; 399/121; 399/388

[58] Field of Search ..... 399/388, 303, 399/304, 121, 297, 312, 316

[56] References Cited

U.S. PATENT DOCUMENTS 4,864,367 9/1989 Nakahara et al. ..... 399/303

FOREIGN PATENT DOCUMENTS 59-101682 6/1984 Japan .

A-64-81734 3/1989 Japan .

A-4-98279 3/1992 Japan .

A-4-149569 5/1992 Japan .

A-4-345185 12/1992 Japan .

A-5-11632 1/1993 Japan .

*Primary Examiner*—Joan H. Pendegrass

*Assistant Examiner*—Quana Grainger

*Attorney, Agent, or Firm*—Oliff & Berridge

[57] ABSTRACT

To bring a sheet 6 electrostatically into intimate contact with a conveyor belt 1 for transporting the sheet 6 by attraction means 60, a press roll 50A for pressing the sheet 6 against the conveyor belt 1 is disposed upstream from the attraction means 60. The press roll 50A is formed at the center with a large diameter part 51 for pressing the center of the sheet 6 stronger than both ends thereof. When transfer to the rear side of the sheet is executed at double-sided image formation, if both ends of the sheet 6 come in contact with the conveyor belt 1, the center of the sheet 6 is pressed strong, whereby deformation at the center is suppressed and a swell is smoothed out in the both-end direction. Relief parts at the rear end of the sheet are also prevented. Resultantly, the intimate contact property of the sheet 6 with the conveyor belt 1 is improved.

7 Claims, 8 Drawing Sheets

IMAGE FORMATION SYSTEM WITH SWELL CORRECTION

BACKGROUND OF THE INVENTION

1. Field of the Invention

This invention relates to an image formation system of a copier, a printer, a facsimile, or the like.

2. Description of the Related Art

In an image formation system of the type wherein an electrostatic latent image formed on an image support such as a photosensitive drum is transferred onto a sheet transported on an endless conveyor belt, unless the sheet is brought into uniformly intimate contact with the surface of the conveyor belt, a partial transfer failure occurs, losing a part of an image, etc., thereby causing reliability to worsen. Particularly, in a full-color image formation system for repeating development for transferring overlapped images, image displacement occurs; it is important to take countermeasures against it.

Hitherto, a proposition to set a proper feed angle and feed position of a sheet to a transfer part formed between an image support and a conveyor belt has been made as described in Japanese Patent Laid-Open Nos. Sho 64-81734 and Hei 4-149569 and 5-11632 as a technique for providing a good intimate contact property of a sheet with the surface of the conveyor belt. A method of placing two stages of attraction rolls for electrostatically attracting a sheet to a conveyor belt upstream from an image support is disclosed in Japanese Patent Laid-Open No. Hei 4-98279. Further, a press member for pressing a sheet against a conveyor belt is disposed downstream from attraction means, as described in Japanese Patent Laid-Open No. Hei 4-345185.

By the way, in recent years, an image formation system of the type wherein an image is automatically formed on both sides of a sheet has been supplied. In double-sided image formation, a sheet is once passed through a fuser and a complete image is formed on one side of the sheet, then an image is formed on the rear side of the sheet using the same passage. A general fuser fixes an image transferred onto a sheet while the sheet is passed through between paired fixing rolls for heating and pressurizing. A problem is that while the sheet is passed through the fixing roll pair, it is stroked and a swell occurs. The swell is often shaped like ribs on both sides from the tip to rear end of sheet 6 along the transport direction of arrow A as shown in FIG. 10. When the sheet 6 with such a swell is turned upside down and is fed to a conveyor belt in an opposite direction to the surface image formation, both end sides in the width direction of the sheet 6 come in contact with the conveyor belt.

FIG. 11 shows attraction means 60 consisting of an attraction corotron 61 and an attraction roll 62 for attracting sheet 6 to a conveyor belt (not shown) and a press roll 80 being disposed upstream from the attraction means 60 in transport direction A for pressing the sheet 6 against the conveyor belt for correcting a swell. An image formation unit containing a photosensitive drum (not shown) is disposed downstream from the attraction means 60. When the sheet 6 is fed between the press roll 80 and the conveyor belt to form an image on the rear side of the sheet as described above, both end sides in the width direction of the sheet 6 come in contact with the conveyor belt and are thus first pressed by the press roller 80. For this reason, deformation is prone to occur at the center of the sheet. As the sheet is transported, the deformation is swelled to the rear end of the sheet and ultimately relief parts 90 occur. The relief parts 90 demonstrate a propensity to occur in the range within 40 mm of the rear end of the sheet. The relief parts 90 are not corrected during the image formation and remain to the end. Resultantly, a transfer failure occurs and the image quality drastically degrades. Such a problem involved in double-sided image formation cannot be solved by the techniques described above and means for solving the problem is desired.

SUMMARY OF THE INVENTION

The present invention has been made to eliminate the above problem with the conventional system, and therefore an object of the invention is to provide an image formation system that can correct a swell occurring during double-sided image formation and maintain good image quality.

To the end, according to the invention, there is provided an image formation system comprising a conveyor belt for transporting a sheet, means for attracting the sheet to a surface of the conveyor belt, an image formation unit being disposed downstream from the attraction means on a transport passage of the conveyor belt for transferring a visible image to the sheet, press means being disposed upstream from the attraction means on the transport passage for pressing the sheet fed to the surface of the conveyor belt against the conveyor belt, means for feeding the sheet into a space between the press means and the conveyor belt, and center reinforcement means for causing the press means to press a center stronger than both ends in a width direction orthogonal to a transport direction of the conveyor belt.

According to the invention, when transfer to the rear side of a sheet is executed at the double-sided transfer time, the sheet fed to the conveyor belt is pressed against the conveyor belt by the press means. At this time, it is pressed at the center in the width direction stronger than at both ends of the sheet, whereby no deformation occurs at the center and a swell is pushed in the both-end direction and is smoothed out. Therefore, relief parts caused by swelling at the rear end of the sheet are prevented from occurring. The sheet with the swell thus smoothed out by the press means is brought into uniformly intimate contact with the surface of the conveyor belt by the attraction means at the following stage. Resultantly, good transfer with no displacement is executed.

BRIEF DESCRIPTION OF THE DRAWINGS

The above and other objects and features of the present invention will be more apparent from the following description taken in conjunction with the accompanying drawings.

DETAILED DESCRIPTION OF THE PREFERRED EMBODIMENTS

A description will be given in more detail of embodiments of the present invention with reference to the accompanying drawings.

First Embodiment

General Configuration of Image Formation System

Figure 1:
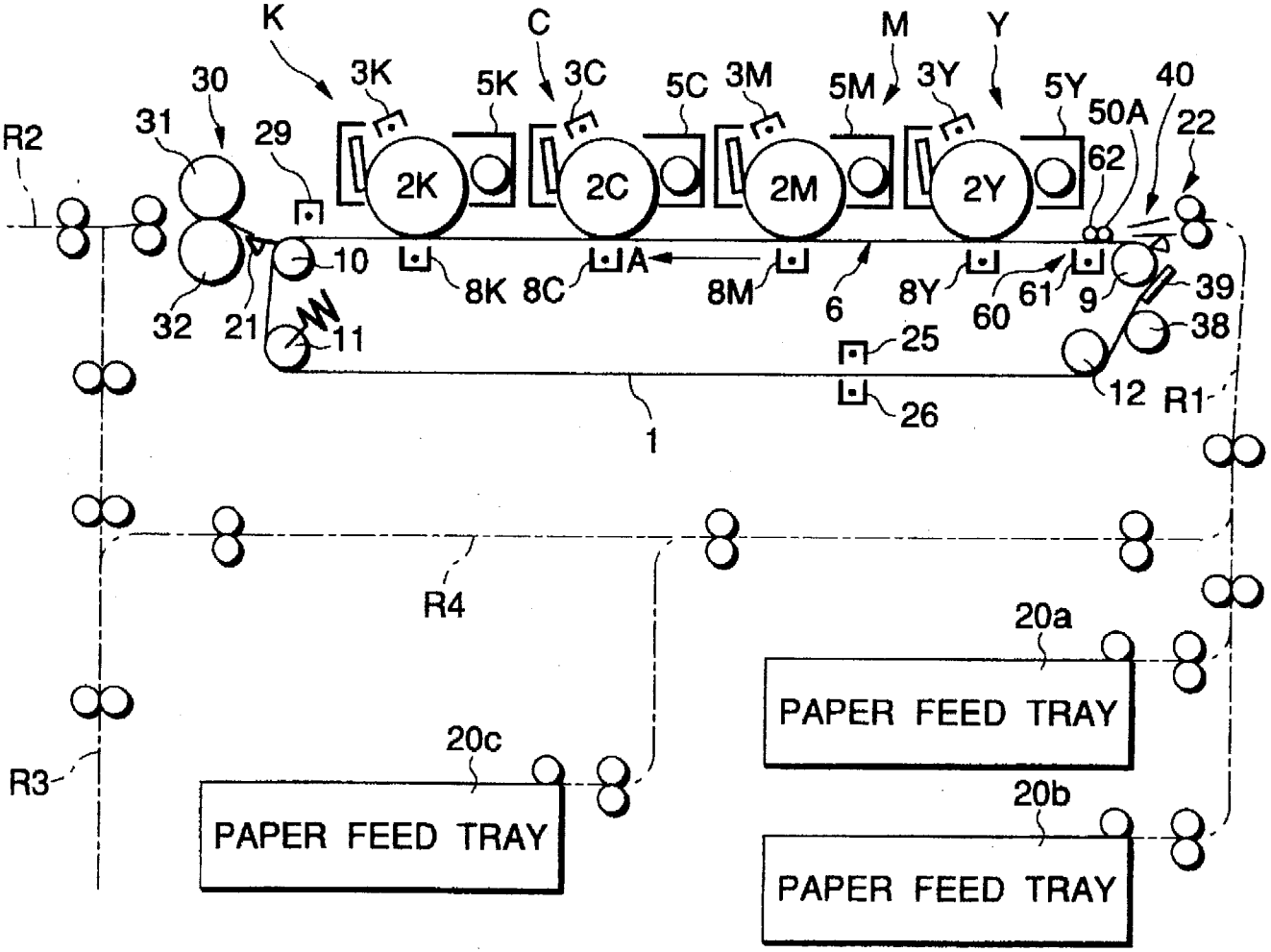
FIG. 1 is a schematic side view of an image formation system to which first, second, and third embodiments of the invention are applied.

FIG. 1 is a schematic diagram to show an image formation system according to a first embodiment of the invention. This image formation system is a so-called tandem-type full-color image formation system. In FIG. 1, numeral 1 is an endless conveyor belt being placed on a drive roll 9, a tension application roll 11, and idler rolls 10 and 12 and rotatable counterclockwise in the figure as indicated by arrow A along an almost rectangular track in landscape (horizontal) orientation. The conveyor belt 1 is driven by the drive roll 9 and is given a tension by the tension application roll 11 for running around the rolls 9–12.

Photosensitive drums 2 (2Y, 2M, 2C, and 2K) are placed for rotation above the conveyor belt 1. Charge corotrons 3Y, 3M, 3C, and 3K, latent image writers (not shown), and developing devices 5Y, 5M, 5C, and 5K are placed around the photosensitive drums 2Y, 2M, 2C, and 2K. The charge corotrons 3Y, 3M, 3C, and 3K charge the surfaces of the photosensitive drums 2Y, 2M, 2C, and 2K uniformly, for example, at −500 to −800 V. The latent image writers irradiate the charged photosensitive drums 2Y, 2M, 2C, and 2K with laser light based on write command signals with colors separated for forming electrostatic latent images. The developing devices 5Y, 5M, 5C, and 5K deposit toner on the electrostatic latent images for visualizing the latent images. They supply yellow toner, magenta toner, cyan toner, and black toner to the photosensitive drums 2Y, 2M, 2C, and 2K. The toner is charged to the same polarity as the charge polarity of the photosensitive drums 2Y, 2M, 2C, and 2K (negative) and is deposited on the surfaces of the photosensitive drums 2Y, 2M, 2C, and 2K by a so-called reverse developing action.

The conveyor belt 1 is driven by the drive roll 9 and runs in contact with the photosensitive drums 2Y, 2M, 2C, and 2K; a sheet 6 is attracted onto the surface of the conveyor belt 1 and as the conveyor belt 1 runs, the sheet 6 comes in contact with the photosensitive drums 2Y, 2M, 2C, and 2K. It is selected from among sheets on any of paper feed trays 20*a*, 20*b*, and 20*c*, then is transported by transport roll and fed through a feed passage R1 to the conveyor belt 1. To feed the sheet 6 to the conveyor belt 1, the sheet 6 is registered at a registration gate 22 and is made to wait to a predetermined timing. When the sheet 6 is released from the registration gate 22, it passes through a shoot (feed means) 40 and is pressed against the surface of the conveyor belt 1 by a press roll 50A, then is electrostatically attracted to the conveyor belt 1 by attraction means 60 consisting of an attraction corotron 61 and an attraction roll 62.

Transfer corotrons 8 (8Y, 8M, 8C, and 8K) are placed on the opposite side to the photosensitive drums 2Y, 2M, 2C, and 2K viewed from the conveyor belt 1. Positive voltage is applied to the transfer corotrons 8Y, 8M, 8C, and 8K. An electric field action caused by corona discharge occurring here causes toner charged negatively on the photosensitive drums 2Y, 2M, 2C, and 2K to be transferred to the sheet 6 on the conveyor belt 1. Each time the sheet 6 thus passes through the photosensitive drums 2Y, 2M, 2C, and 2K, yellow toner, magenta toner, cyan toner, and black toner are transferred onto the sheet 6.

The photosensitive drums 2 (2Y, 2M, 2C, and 2K), the charge corotrons 3Y, 3M, 3C, and 3K, the latent image writers (not shown), the developing devices 5Y, 5M, 5C, and 5K, and the transfer corotrons 8 (8Y, 8M, 8C, and 8K) make up yellow, magenta, cyan, and black image formation units Y, M, C, and K.

The sheet 6 onto which multi-color toner is thus transferred arrives at an electricity removal corotron 29 as the conveyor belt 1 runs. The attraction force between the sheet 6 and the conveyor belt 1 is weakened at the electricity removal corotron 29, then the sheet 6 is stripped off from the conveyor belt 1 by a stripping claw 21. While the sheet 6 is passed through between a heating roll 31 and a pressurizing roll 32 of a fuser 30, toner is fixed to the sheet 6. The toner receives heat and pressure therebetween and is fused to the sheet 6, generating multiple colors. An image is thus fixed onto the sheet.

The sheet 6 passed through the fuser 30 is transported on a discharge passage R2 and is discharged. If an image is also formed on the opposite side to the image formation side of the sheet 6, the sheet 6 is introduced into a double-sided transfer reverse passage R3 and further into a double-sided transfer transport passage R4 and is again fed to the feed passage R1.

On the other hand, the conveyor belt 1 is subjected to electricity removal by belt electricity removal corotrons 25 and 26 and is cleaned by a cleaning roll 38 and a cleaning blade 39 for transporting another sheet 6 supplied through the registration gate 22.

Attraction Means

Figure 2:
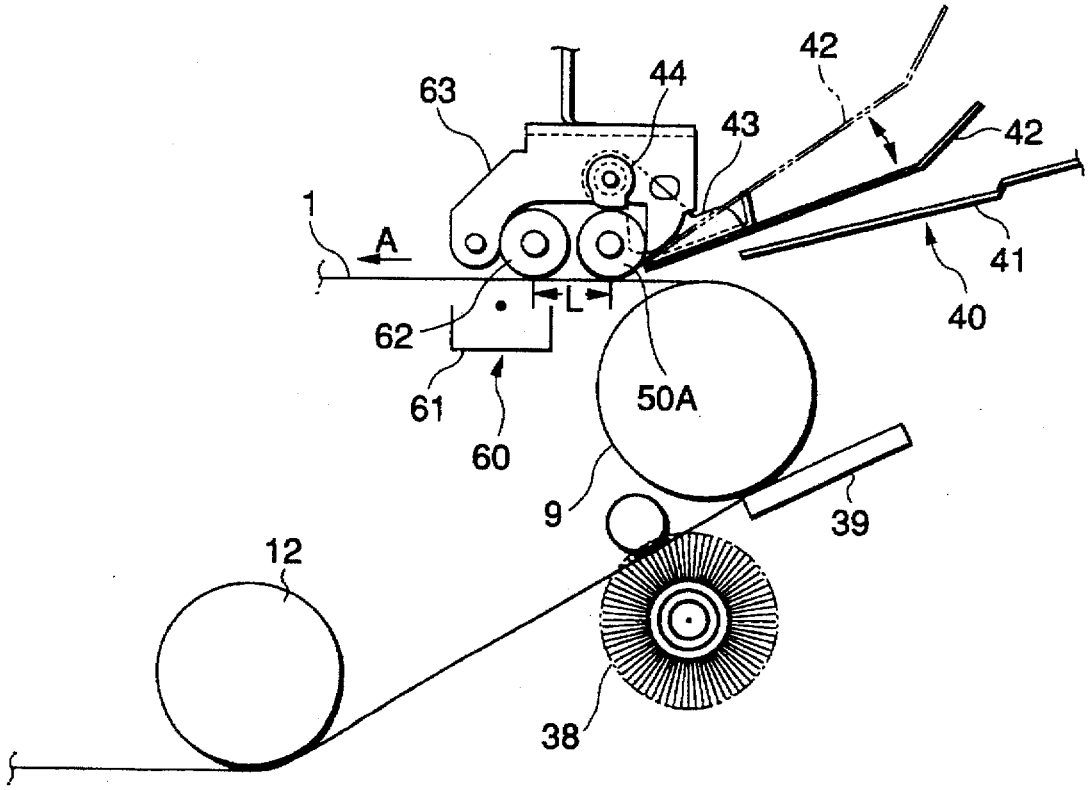
FIG. 2 is a side view to show a sheet feed portion to a conveyor belt to which the first embodiment of the invention is applied.

The attraction means 60 is made up of the attraction roll 62 disposed on the surface of the conveyor belt 1 and the attraction corotron 61 disposed facing the attraction roll 62 with the conveyor belt 1 between, as shown in FIG. 2. Positive voltage is applied to the attraction corotron 61. The attraction roll 62, whose axial direction is orthogonal to the transport direction of the conveyor belt 1, is attached rotatably to a bracket 63. It is in contact with the surface of the conveyor belt 1 under reasonable pressure and is pulled down as a counter electrode of the attraction corotron 61. A sheet 6 charged negatively by an electric field action caused by corona discharge occurring at the attraction corotron 61 is attracted on the conveyor belt 1.

Shoot

The shoot 40, which is provided to feed a sheet 6 between the conveyor belt 1 and the press roll 50A, is made up of a fixed lower shoot 41 and a moving upper shoot 42 with the rear end in the transport direction opening up and down, as shown in FIG. 2. A stay 43 is fixed to the tip of the upper shoot 42 and is attached rotatably to the bracket 63 via a pivot 44 orthogonal to the transport direction of the sheet 6. The upper shoot 42 rotates about the pivot 44 between the normal position indicated by the solid line in FIG. 2 and the open position indicated by the alternate long and two short dashes line. The sheet 6 is fed through the shoot 40 into a space between the conveyor belt 1 and the press roll 50A. The upper shoot 42 is controlled so that it is at the normal position until the sheet is transported at a predetermined length after it is introduced and that the upper shoot 42 rotates to the open position so as to allow a loop of the rear end of the sheet when the rear end of the sheet passes through.

Press Roll

The press roll 50A is disposed slightly away from and in parallel with the attraction roll 62 upstream therefrom, is attached rotatably to the bracket 63, and is pulled down together with the attraction roll 62. It comes in contact with the surface of the conveyor belt 1 under reasonable pressure. The sheet 6 is pressed against the conveyor belt 1 by the press roll 50A and thereby has any swell that may be present smoothed out.

Figure 3A:
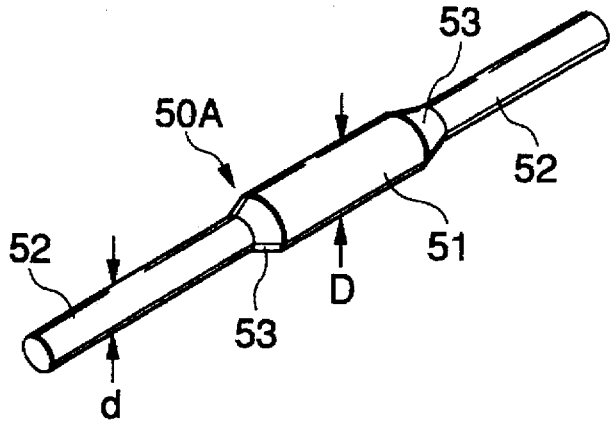
FIGS. 3A, 3B and 3C are perspective views to show different forms of press rolls.

The press roll 50A is made of a roll with the axial center slightly larger in diameter than both ends, as shown in FIG. 3A. That is, the center is formed with a large diameter part (center reinforcement means) 51 and a small diameter part 52 is formed on both sides of the large diameter part 51. The diameter of the large diameter part 51, D, and that of the small diameter part 52, d, are set so as to satisfy the relation D>d. A taper-like transition part 53 is formed between the large diameter part 51 and the small diameter part 52. The large diameter part 51 corresponds to the center in the width direction of the sheet 6 transported on the conveyor belt 1 and the small diameter parts 52 correspond to both sides of the sheet. As shown in FIG. 2, the press roll 50A is disposed in the range in which the distance from the attraction means 60, L, is within 40 mm.

Function of Press Roll at Rear Side Transfer Time

Figure 10:
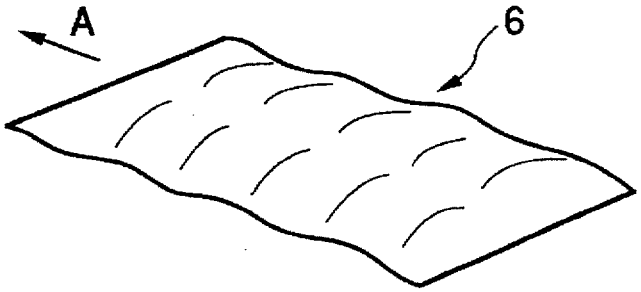
FIG. 10 is a perspective view of a sheet passed through a fuser.
Figure 11:
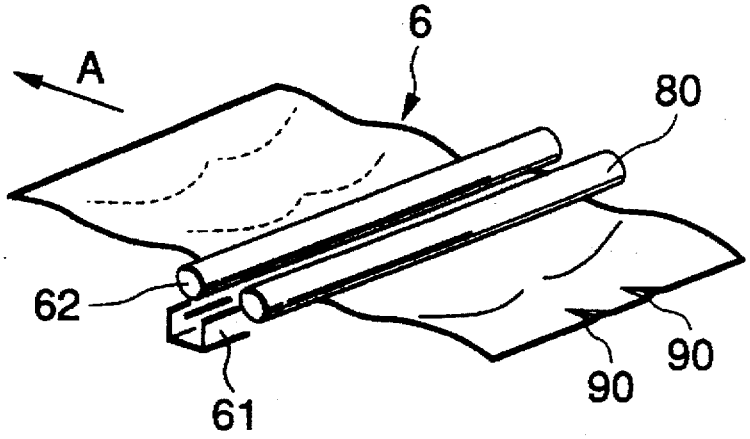
FIG.11 RELATED ART
FIG. 11 is a perspective view to show an example of a conventional system.

Particularly at the double-sided transfer time (when an image is formed on the surface of a sheet 6 and then another image is formed on the rear side of the sheet) the press roll 50A has the following proper effect on the sheet 6:

At the double-sided transfer time, the sheet 6 passed through the fuser 30 is introduced into the double-sided transfer reverse passage R3 and further into the double-sided transfer transport passage R4 and is again fed to the feed passage R1. The sheet 6 is turned upside down and is fed from the shoot 40 to the conveyor belt 1 in an opposite direction to the surface image formation. Next, the sheet 6 is pressed against the conveyor belt 1 by the press roll 50A, then is attracted to the surface of the transfer belt 1 by the attraction means 60. A rib-like swell as shown in FIG. 10 occurs on the sheet 6 passed through the fuser 30 and formed with an image on the surface, as described above. The swell causes the sheet 6 fed to the conveyor belt 1 to come at both ends in contact with the conveyor belt 1.

Figure 12:
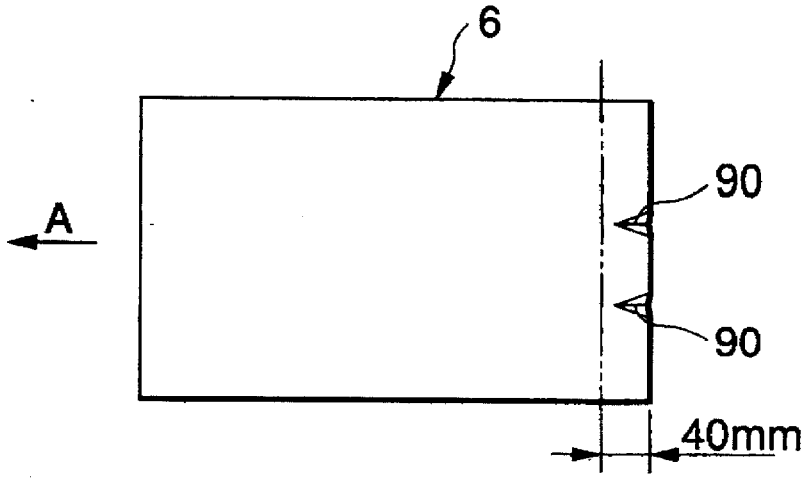
FIG.12 RELATED ART
FIG. 12 is a plan view of a sheet having relief parts occurring at the rear end of a transport direction.

If the sheet 6 is pressed against the conveyor belt 1 by a normal press roll of a uniform diameter, both ends of the sheet are pressed preferentially and the center of the sheet is prone to deform. However, the center of the press roll 50A of the embodiment has a large diameter, so that the center of the sheet is pressed stronger than the both ends of the sheet. That is, the sheet 6 is pressed by the large diameter part 51 of the press roll 50A and the small diameter parts 52 of both sides thereof; the center in the width direction of the sheet is pressed preferentially by the large diameter part 51 of the press roll 50A stronger than both sides of the sheet, thereby preventing the center of the sheet 6 from deforming, and pushing the rib-like swell in the both-end direction and smoothing out the swell. Therefore, swelling to the rear end does not occur, preventing the relief parts 90 at the rear end shown in FIG. 12 from occurring. Resultantly, the sheet 6 is brought into uniformly intimate contact with the surface of the conveyor belt 1 and good transfer with no displacement is executed. The relief parts 90 occur in the range within 40 mm from the rear end of the sheet 6 previously described with reference to FIG. 12. However, the press roll 50A is disposed in the range within 40 mm upstream from the attraction means 60, thus the relief parts 90 are particularly suppressed. Since the press roll 50A also serves as center reinforcement means (in this case, the large diameter part 51), the system can be compacted and its manufacturing cost can be reduced.

Figure 4:
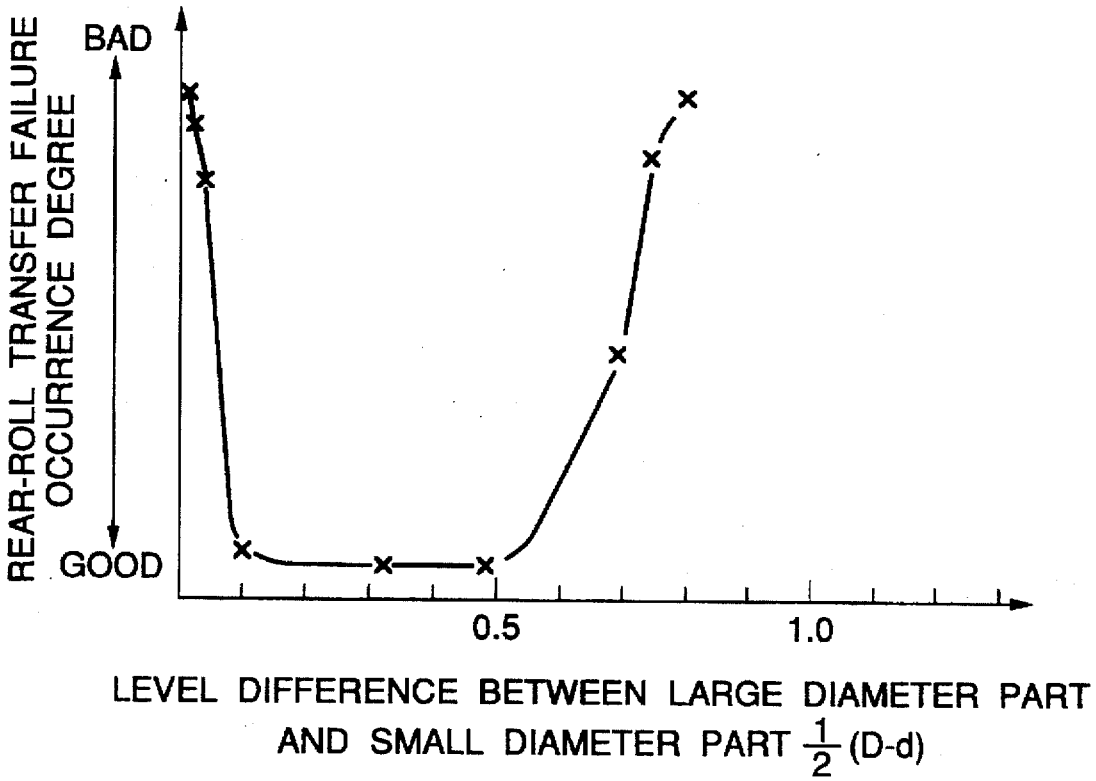
FIG. 4 is a graph to show the relationship between the level difference between large and small diameter parts of the press roll and transfer failure occurrence degree.
Figure 5:
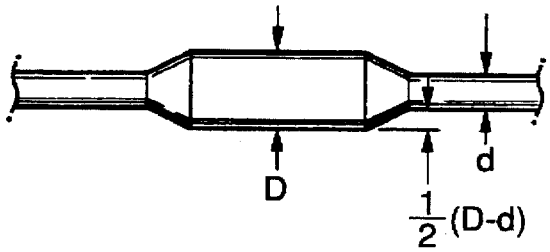
FIG. 5 is a side view of the press roll.

As the specific size of the press roll 50A, preferably the diameter of the small diameter part 52, d, ranges from 8 mm to 12 mm and the diameter of the large diameter part 51, D, is in the range of d+(0.2–1.0) mm. Therefore, preferably the level difference between the large diameter D and the small diameter d is in the range of about 0.1–0.5 mm. If this range is exceeded, the roller cannot be expected to push the swell to both ends of the sheet. Preferably, the lower limit value is about 1 mm for normally used sheets 0.1 mm or less thick. FIG. 5 shows the side face of the press roll 50A wherein ½ (D-d) is the level difference between the large diameter part 51 and the small diameter part 52. FIG. 4 shows the relationship between the level difference and transfer failure occurrence degree. As seen in FIG. 4, when the level difference is about 0.1–0.5 mm, the best transfer is executed and when the level difference deviates from this range, transfer remarkable worsens.

Modifications of First Embodiment

The press roll 50A has the large diameter part 51 axially continuous as center reinforcement means; if the large diameter part 51 is divided in the axial direction of the conveyor belt 1, a better swell smoothing-out effect can be produced.

Figure 3B:
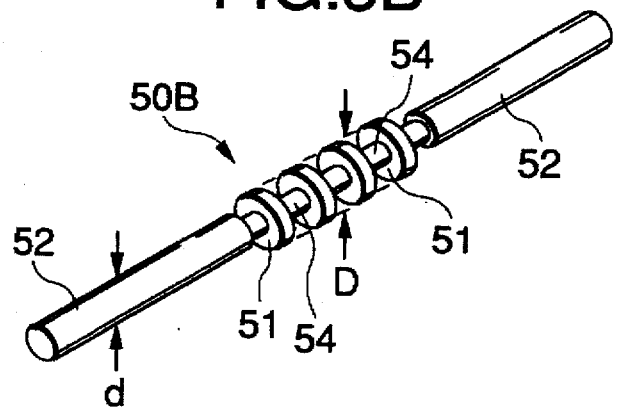
Figure 3C:
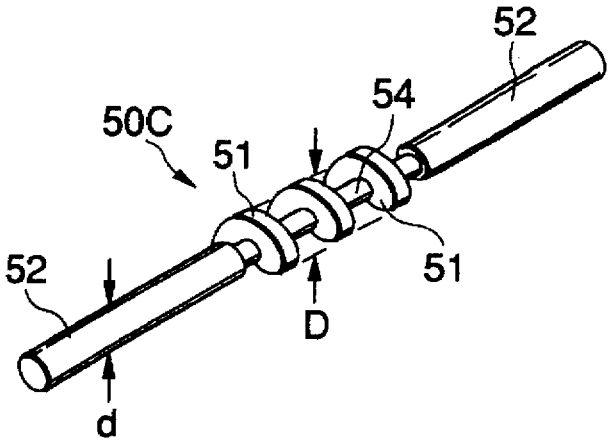

Large diameter parts 51 of a press roll 50B in FIG. 3B are formed like round slices with grooves 54 equally spaced from each other in the axial direction between. A small diameter part 52 is axially continuous. Large diameter parts 51 of a press roll 50C in FIG. 3C are formed in a helical fashion at given pitches with grooves 54 between. A small diameter part 52 is axiallly continuous. For both the press rolls 50B and 50C, the diameter of the large diameter part 51, D, and that of the small diameter part 52, d, are set so as to satisfy the relation D>d.

If the large diameter part 51 is thus divided when viewed in the axial direction, a swell is relieved to the groove 54 and is smoothed out by the next large diameter part 51, and so on. Therefore, the swell is not crushed and can be removed efficiently and the intimate contact property of the sheet 6 with the conveyor belt 1 is furthermore improved.

Second Embodiment

Configuration of Second Embodiment

Figure 6:
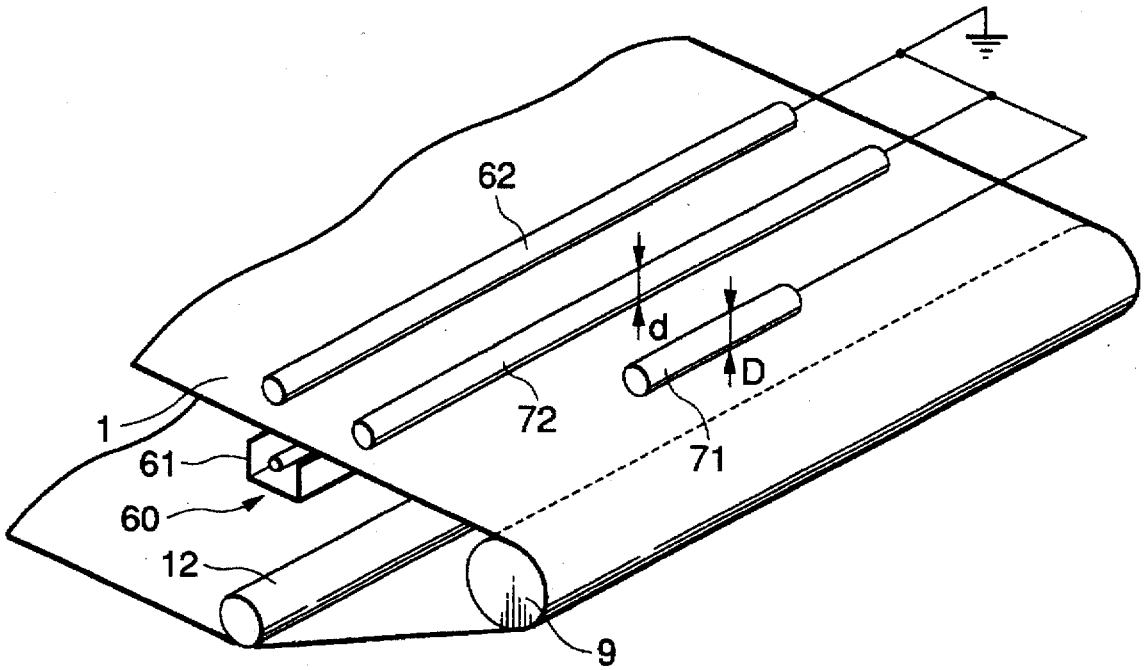
FIG. 6 is a perspective view to show the second embodiment of the invention.

FIG. 6 shows a second embodiment of the invention. In the second embodiment, first and second press rolls (center reinforcement means) 71 and 72 are disposed upstream in a transport direction as means for pressing a sheet 6 against a conveyor belt 1. The second press roll 72 on the side of an attraction roll 62 is a normal roll of an equal diameter and has a length covering all the width of the conveyor belt 1. The first press roll 71 upstream from the second press roll 72 is a short roll acting only on the center in the width direction of the conveyor belt 1 and has an equal diameter. The diameter of the first press roll 71, D, and that of the second press roll 72, d, are set so as to satisfy the relation D>d. Rotation shafts of both the press rolls 71 and 72 are equally distant from the surface of the conveyor belt 1. Therefore, the first press roll 71 has a larger press force against the sheet 6 than the second press roll 72. The first press roll 71 is disposed in the range within 40 mm upstream from the attraction means 60. The press rolls 71 and 72 are pulled down together with the attraction roll 62.

Function of Second Embodiment

According to the first and second press rolls 71 and 72, first a sheet 6 is pressed at the center in the width direction thereof by the first press roll, next is pressed in all area of the sheet 6 by the second press roll 72. The press action of the first press roll 71 presses the center in the width direction of the sheet 6 stronger than both ends thereof. For transfer to the rear side of the sheet, while deformation of the center is suppressed, the whole swell is smoothed out and no relief parts occur at the rear end.

According to the second embodiment, a swell of the sheet 6 is smoothed out and the sheet 6 is brought into uniformly intimate contact with the conveyor belt 1 by the simple configuration wherein in addition to the normal press roll 72 of a uniform diameter, the short press roll 71 larger in diameter than the press roll 72 is disposed at the center upstream of the conveyor belt 1.

Third embodiment

Configuration of Third Embodiment

In the first and second embodiments, the large diameter part 51 of the press roll 50 or the first press roll 71 of a large diameter is used as the center reinforcement means; in the third embodiment, an upper shoot 42 is provided with center reinforcement means.

Figure 7:
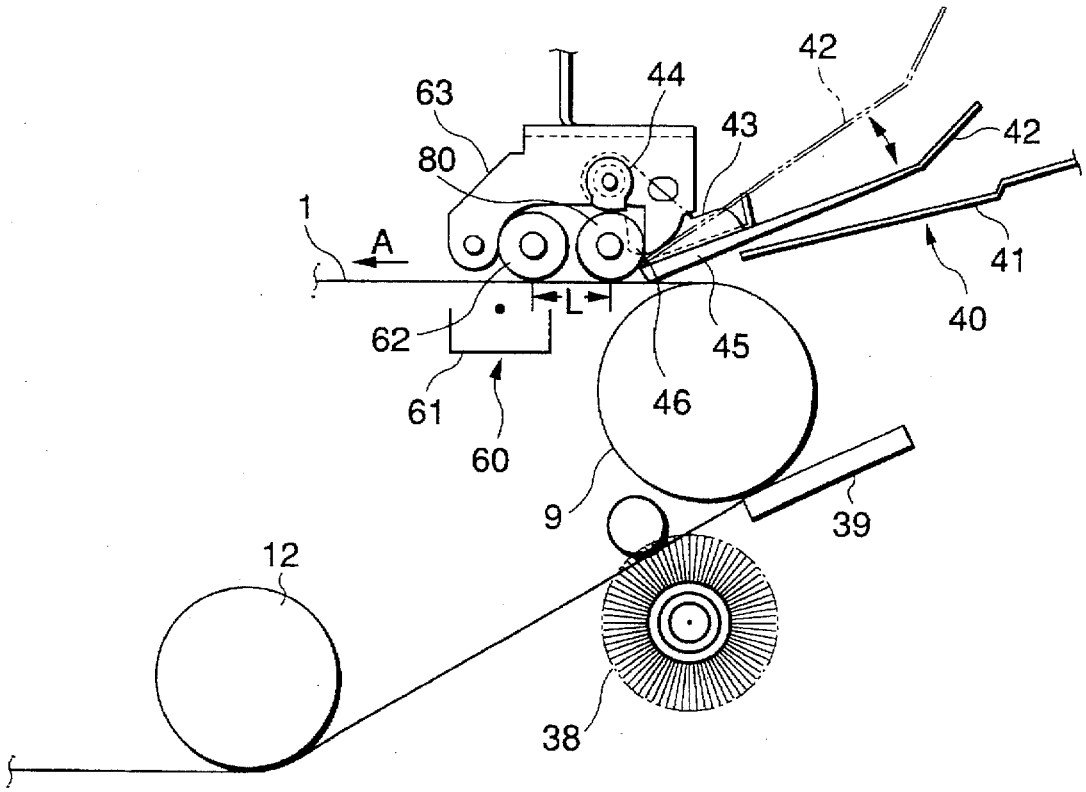
FIG. 7 is a side view to show a sheet feed portion to a conveyor belt to which the third embodiment of the invention is applied.
Figure 8:
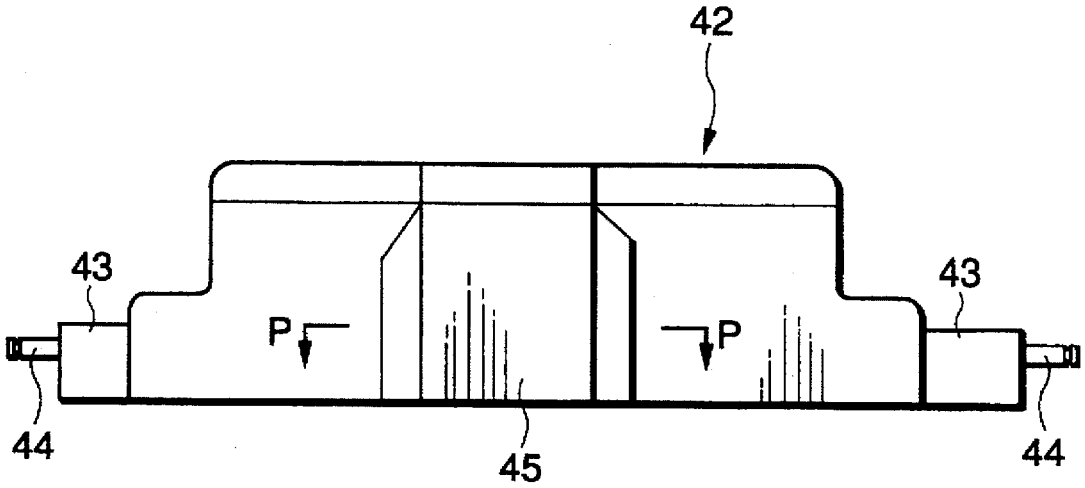
FIG. 8 is a bottom view of a press plate.
Figure 9:
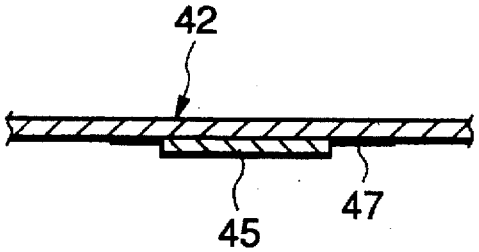
FIG. 9 is a sectional view taken on arrow lines P—P in FIG. 8.

As shown in FIGS. 8 and 9, the upper shoot 42 is a plate member having a width sufficiently capable of covering the width of a sheet 6 of the largest size and is provided with a thin rectangular press plate (center reinforcement means) 45 at the center in the width direction of the bottom face. The press plate 45 increases in thickness as it proceeds toward the tip side in the transport direction as shown in FIG. 7, and is fixedly secured to the center of the bottom face of the upper shoot 42 with double adhesive tape 47. Preferably, the surface of the press plate 45 opposed to a conveyor belt 1 is coated with a material excellent in slidability, such as fluorine, so that it does not damage a sheet 6. Means for fixedly securing the press plate 45 to the upper shoot 42 may be heat welding or ultrasonic welding depending on the material. When the upper shoot 42 is at the normal position, the press plate 45 causes a tip edge 46 to press the sheet 6 against the conveyor belt 1. On the other hand, a press roll 80 is a normal roll of an equal diameter, in this case. The press force of the edge 46 of the press plate 45 against the sheet 6 is set larger than that of the press roll 80. The edge 46 is disposed in the range in which the distance from attraction means 60, L, is within 40 mm.

Function of Third Embodiment

When the sheet 6 passes through a shoot 40, it is pressed at the center in the width direction thereof by the edge 46 of the press plate 45. The entire sheet 6 is then pressed by the press roll 80. The press action of the press plate 45 presses the center in the width direction of the sheet 6 stronger than both ends thereof. Resultantly, as in the first embodiment, while deformation of the center is suppressed, the whole swell is smoothed out and no relief parts occur at the rear end. Since the press plate 45 is of a simple structure and moreover is disposed on the upper shoot 42, the system can be compacted and its manufacturing cost can be reduced.

Modifications of the Invention

The forms of the invention are not limited to the embodiments previously described and, for example, the following modifications are possible:

(1) The large diameter part 51 of the press roll 50 of the first embodiment is made symmetrically helical so that it is opened to both sides from the center of the axial direction, whereby the effect of smoothing out a swell to both ends is produced more efficiently.

(2) The first press roll 71 of the second embodiment is formed like round slices or made helical as in the modification of the first embodiment, thereby improving the effect of smoothing out a swell.

(3) The edge 46 of the press plate 45 of the third embodiment is made saw-toothed to the degree to which it does not damage the sheet 6, thereby improving the effect of smoothing out a swell.

(4) In addition to the press roll 50, 71 or the press plate 45, the press force reinforcement means may be any form if it presses the center in the width direction of the sheet 6 stronger than both ends thereof.

As we have discussed, according to the invention, a sheet fed to the conveyor belt is pressed at the center in the width direction stronger than at both ends of the sheet by the center reinforcement means of the press means. Thus, if transfer to the rear side of the sheet is executed at the double-sided transfer time, a swell is removed efficiently. Resultantly, the sheet is brought into uniformly intimate contact with the conveyor belt by the attraction means, and good image formation with no displacement is executed.

Since the press means is disposed in the range within 40 mm upstream from the attraction means on the transport passage, relief parts caused by swelling occurring in the range within 40 mm of the rear end of the sheet can be prevented efficiently.

Since the press means is disposed on the feed means, the system can be compacted and its manufacturing cost can be reduced.

Since the center reinforcement means of the press means is divided in the width direction of the conveyor belt, the effect of smoothing out a swell is enhanced and the intimate contact property of the sheet with the conveyor belt is furthermore improved.

Since the press means has the axial center made of the roll having a larger diameter than other portions and the larger diameter part serves as the center reinforcement means, the press roll can also serve as the center reinforcement means; the system can be compacted and its manufacturing cost can be reduced.

Since the press means comes in contact with the conveyor belt under a given load, the effect of smoothing out a swell is made constant and the sheet is not damaged and a good transfer image is provided.

Since a level difference between the larger diameter roll and other portions ranges from 0.1 mm to 0.5 mm, a swell is smoothed out uniformly throughout the sheet, thereby providing a good transfer image.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image formation system comprising:

a conveyor belt for transporting a sheet;

means for attracting the sheet to a surface of said conveyor belt;

an image formation unit being disposed downstream from said attraction means on a transport passage of said conveyor belt for transferring a visible image to the sheet;

press means being disposed upstream from said attraction means on the transport passage for pressing the sheet fed to the surface of said conveyor belt against said conveyor belt;

means for feeding the sheet into a space between said press means and said conveyor belt; and center reinforcement means for causing said press means to press a center stronger than both ends in a width direction orthogonal to a transport direction of said conveyor belt.

2. The image formation system as claimed in claim 1 wherein said press means is disposed in a range within 40 mm upstream from said attraction means on the transport passage.

3. The image formation system as claimed in claim 1 or 2 wherein said press means is disposed on said feed means.

4. The image formation system as claimed in claim 1 wherein said center reinforcement means of said press means is divided in a width direction of said conveyor belt.

5. The image formation system as claimed in claim 1 wherein said press means has an axial center made of a roll having a larger diameter than other portions and wherein the larger diameter part serves as said center reinforcement means.

6. The image formation system as claimed in claim 1 wherein said press means comes in contact with said conveyor belt under a given load.

7. The image formation system as claimed in claim 5 wherein a level difference between the larger diameter roll and other portions ranges from 0.1 mm to 0.5 mm.

* * * * *